US009562387B2

(12) United States Patent
Meeks

(10) Patent No.: US 9,562,387 B2
(45) Date of Patent: Feb. 7, 2017

(54) DOOR BOTTOM SYSTEM FOR AN ENTRYWAY SYSTEM

(71) Applicant: Quanex Corporation, Houston, TX (US)

(72) Inventor: James W. Meeks, Eaton, OH (US)

(73) Assignee: QUANEX HOMESHIELD LLC, Rice Lake, WI (US)

( * ) Notice: Subject to any disclaimer, the term of this patent is extended or adjusted under 35 U.S.C. 154(b) by 0 days.

(21) Appl. No.: 14/695,415

(22) Filed: Apr. 24, 2015

(65) Prior Publication Data

US 2015/0308180 A1 Oct. 29, 2015

Related U.S. Application Data

(60) Provisional application No. 61/983,547, filed on Apr. 24, 2014.

(51) Int. Cl.
*E06B 1/70* (2006.01)
*E06B 7/23* (2006.01)

(52) U.S. Cl.
CPC ..... *E06B 1/70* (2013.01); *E06B 7/2305* (2013.01); *E06B 7/2316* (2013.01)

(58) Field of Classification Search
CPC ..... E06B 1/70; E06B 7/2316; E06B 7/2305
USPC ..... 49/467–471
See application file for complete search history.

(56) References Cited

U.S. PATENT DOCUMENTS 1,468,958 A * 9/1923 Champion ..... E06B 7/205 49/304
3,521,404 A 7/1970 Hager et al.
4,006,562 A * 2/1977 Belanger ..... E06B 7/2314 49/380
4,831,779 A * 5/1989 Kehrli ..... E06B 1/70 49/380
5,056,263 A * 10/1991 Bies ..... E06B 7/2316 49/470
5,067,279 A * 11/1991 Hagemeyer ..... E06B 1/70 49/470
5,943,825 A 8/1999 Procton et al.
6,052,949 A 4/2000 Procton et al.
6,367,201 B1 4/2002 Massey et al.
6,371,188 B1 4/2002 Baczuk et al.
6,374,545 B1 * 4/2002 Baczuk ..... E06B 7/23 49/470

(Continued)

*Primary Examiner* — Katherine Mitchell
*Assistant Examiner* — Marcus Menezes
(74) *Attorney, Agent, or Firm* — Howard & Howard Attorneys PLLC

(57) ABSTRACT

A door bottom system is used with an entryway system having a door panel movable between open and closed positions. The door bottom system includes a door sweep movable with the door panel between first and second positions corresponding with the open and closed positions, respectively. The door bottom system includes a threshold assembly including a sill that defines a channel adapted for accepting a fluid. The threshold assembly includes a seal extending downwardly toward the sill to a distal end and movable between initial and sealed positions. The door sweep selectively engages and moves the seal from the initial position in the first position to the sealed position in the second position. The seal extends over and covers the channel in the initial position. The seal at least partially uncovers the channel in the sealed position such that the distal end of the seal is positioned above the channel.

20 Claims, 12 Drawing Sheets

(56) References Cited

U.S. PATENT DOCUMENTS

| | | | | |
|---|---|---|---|---|
| 7,472,516 | B2 | 1/2009 | Pepper et al. | |
| 7,669,369 | B2 | 3/2010 | Henry et al. | |
| 8,375,659 | B2 | 2/2013 | Bogenhagen et al. | |
| 8,522,483 | B2 * | 9/2013 | Van Camp | E06B 1/70 49/303 |
| 8,813,427 | B2 | 8/2014 | Meeks | |
| 2013/0199100 | A1 * | 8/2013 | Van Camp | E06B 1/70 49/468 |
| 2013/0276376 | A1 | 10/2013 | Gilbert et al. | |
| 2014/0318020 | A1 | 10/2014 | Van Camp et al. | |
| 2015/0013232 | A1 | 1/2015 | Rager-Frey | |

* cited by examiner

DOOR BOTTOM SYSTEM FOR AN ENTRYWAY SYSTEM

RELATED APPLICATION

This application claims priority to and all advantages of U.S. Provisional Patent Application No. 61/983,547, which was filed on Apr. 24, 2014, the disclosure of which is specifically incorporated by reference.

BACKGROUND OF THE INVENTION

1. Field of the Invention

The subject invention relates to a door bottom system for an entryway system.

2. Description of Related Art

Entryway systems typically include a door bottom system. The door bottom system typically includes a door sweep coupled to and configured to move with a door panel of the entryway system and a threshold assembly to seal against the door sweep. The entryway system typically includes a door frame and the door panel. The door panel is pivotal relative to the door frame between open and closed positions. The threshold assembly typically includes a sill and a rail, with the rail disposed on the sill. The rail is disposed below the door sweep when the door panel is in the closed position. The rail may be biased to engage and adjust to the door sweep to create a water-tight seal between the rail and the door panel. In other words, as opposed to setting the door panel and/or the rail to a predetermined height relative to each other at the time of installation to create a proper seal between the door panel and the rail, the rail instead self-adjusts to the door panel when the door panel is in the closed position to seal against the door panel.

Traditionally, the rail is biased upward toward the door panel such that the door panel engages the rail and the rail seals against the door panel. Repeated foot-traffic across the rail and/or repeated engagement by the rail may degrade the upward bias of the rail toward the door panel to seal against the door panel. Further, water and debris that infiltrates between the door sweep and the rail is directed toward an interior of the structure. As such, there remains a need to provide an improved door bottom system.

SUMMARY OF THE INVENTION AND ADVANTAGES

The subject invention provides for a door bottom system for use with an entryway system disposed within an aperture of a structure. The structure has an exterior and an interior. The entryway system has a door panel capable of moving between an open position and a closed position. The door bottom system comprises a door sweep disposed below and adapted to be coupled to the door panel. The door sweep is movable between first and second positions corresponding with the open and closed positions of the door panel, respectively.

The door bottom system further comprises a threshold assembly disposed below the door sweep in the second position. The threshold assembly comprises a sill extending along an axis between an exterior side for facing the exterior of the structure and an interior side for facing the interior of the structure. The sill defines a channel between the exterior side and the interior side which is adapted for accepting a fluid therein. The threshold assembly further comprises a seal coupled to the sill and extending at least partially along the axis and downwardly toward the sill to a distal end. The seal is movable along the axis between an initial position and a sealed position. The door sweep selectively engages and moves the seal from the initial position when the door sweep is in the first position to the sealed position when the door sweep is in the second position for preventing infiltration of the fluid from the exterior to the interior of the structure.

The seal extends over and covers the channel in the initial position when the door sweep is in the first position. The seal at least partially uncovers the channel in the sealed position such that the distal end of the seal is positioned above the channel when the door sweep is in the second position for directing any fluid that may infiltrate between the door sweep and the seal off the downwardly extending seal at the distal end and into the channel.

Accordingly, when the door panel is in the open position, the door sweep is in the first position, and the seal is in the initial position, the channel (which may contain the fluid, debris, and/or evaporation stains) is hidden from sight creating a desirable aesthetic appearance. When the door panel is in the closed position, the door sweep is in the second position, and the seal is in the sealed position, disposed on the seal is directed into the channel, preventing intrusion of the fluid into the interior of the structure.

BRIEF DESCRIPTION OF THE DRAWINGS

Advantages of the subject invention will be readily appreciated as the same becomes better understood by reference to the following detailed description when considered in connection with the accompanying drawings.

DETAILED DESCRIPTION OF THE INVENTION

Figure 1:
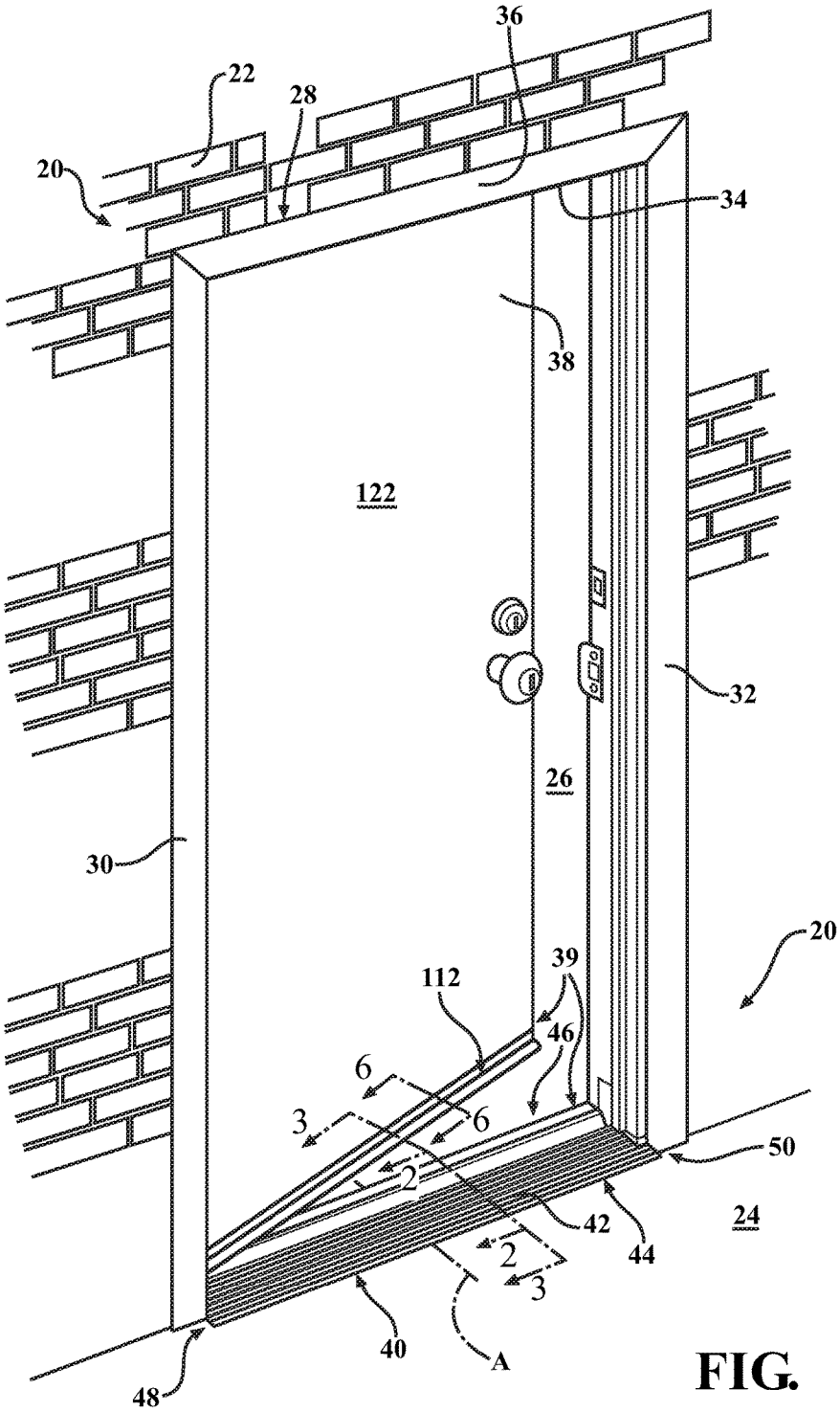
FIG. 1 is a perspective view of an entryway system.
Figure 2:
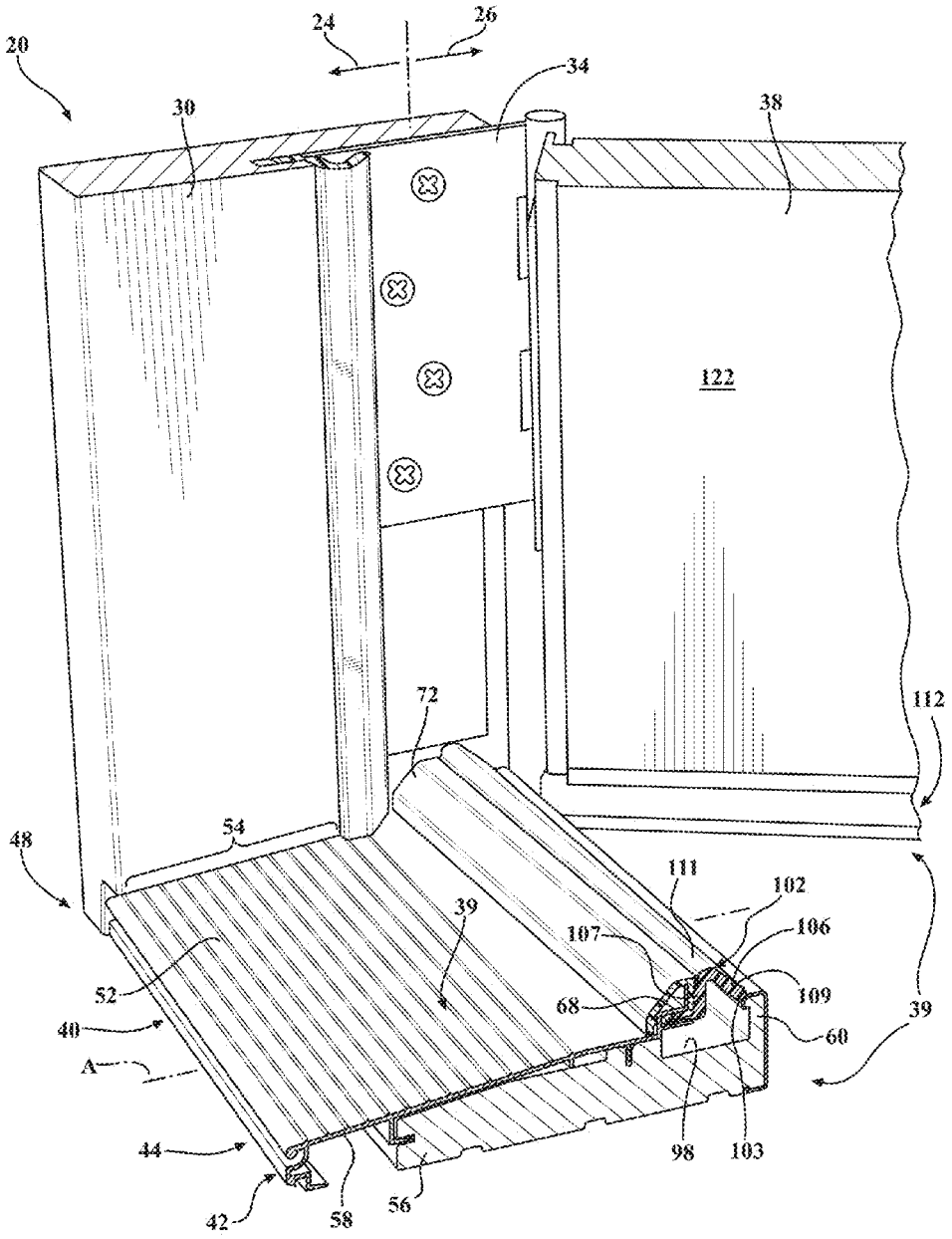
FIG. 2 is a cross-sectional perspective view of a portion of the entryway system taken along 2-2 shown in FIG.1, and showing the cross-section of a door bottom system including a threshold assembly and a door sweep, shown relative to an exterior side of the threshold assembly.

Referring to the Figures, wherein like numerals indicates like or corresponding parts throughout the several views; an entryway system 20 for disposing within an aperture of a structure 22 is generally shown in FIG. 1. The structure 22 is typically a building, such as a commercial or residential building, with the entryway system 20 providing access into the structure 22. The structure 22 has an exterior 24 and an interior 26. More specifically, the structure 22 has a wall dividing the exterior 24 (i.e., an outside environment) and the interior 26 of the structure 22. The entryway system 20 is disposed within the aperture to separate the exterior 24 and the interior 26 of the structure 22. Said differently, the exterior 24 and the interior 26 are disposed on opposite sides of the entryway system 20. As such, the entryway system 20 can be used to access the exterior 24 from the interior 26 of the structure 22 and, alternatively, the entryway system 20 can be used to access the interior 26 from the exterior 24 of the structure 22. It is to be appreciated that the entryway system 20 may be utilized in any suitable configuration for providing access through the wall of the structure 22.

The entryway system 20 typically includes a door frame 28 disposed in the aperture of the structure 22. The door frame 28 includes first and second door jambs 30, 32 spaced from each other. The door frame 28 defines an opening 34 for providing access between the interior 26 and the exterior 24 of the structure 22. Typically, the first and second door jambs 30, 32 are substantially parallel to one another. However, it is to be appreciated that the first and second door jambs 30, 32 may be disposed transverse to one another or in any other suitable configuration. The door frame 28 typically includes a door head 36 transverse to and extending between the first and second door jambs 30, 32.

The entryway system 20 includes a door panel 38. The door panel 38 is typically coupled to the door frame 28 and is capable of moving between an open position, as shown in FIGS. 2-4, and 7-9 and a closed position, as shown in FIGS. 1, 5, 10, and 11. When in the closed position, the door panel 38 is disposed in the opening 34. The door panel 38 is typically pivotally coupled to one of the first and second door jambs 30, 32. The door panel 38 is pivotally coupled to the first door jamb 30 in the Figures for exemplary purposes only. The movement of the door panel 38 between the open and closed positions may be further defined as pivoting between the open and closed positions. Said differently, the door panel 38 is hinged to one of the first and second door jambs 30, 32. The door panel 38 is disposed entirely outside of the opening 34 in the open position. The closed position refers to any position of the door panel 38 in which at least a portion of the door panel 38 extends into the opening 34, as shown in FIGS. 1, 5, 10, and 11. The closed position may further define a completely closed position in which the door panel 38 is entirely disposed within the opening 34, as shown in FIGS. 5, 10, and 11. In the completely closed position, the door panel 38 may abut the door frame 28 to substantially inhibit access through the opening 34.

As shown in FIGS. 2-5 and 7-11, the entryway system 20 includes a door bottom system 39. The door bottom system 39 includes a door sweep 112 disposed below and adapted to be coupled to the door panel 38. The door sweep 112 is movable between first and second positions corresponding with the open and closed positions of the door panel 38, respectively.

The door bottom system 39 includes a threshold assembly 40 disposed below the door sweep 112 in the second position. The threshold assembly 40 includes a sill 42 extending along an axis A between an exterior side 44 for facing the exterior 24 of the structure 22 and an interior side 46 for facing the interior 26 of the structure 22. The sill 42 defines a channel 98 between the exterior side 44 and the interior side 46 which is adapted for accepting a fluid therein.

As set forth in the present application, the fluid is typically water. However, it is to be appreciated that the fluid may be any particular fluid, which may or may not include any debris entrapped therein.

The threshold assembly 40 includes a seal 102 coupled to the sill 42 and extending at least partially along the axis A and downwardly toward the sill 42 to a distal end 103. The seal 102 is movable along the axis A between an initial position and a sealed position. The door sweep 112 selectively engages and moves the seal 102 from the initial position when the door sweep 112 is in the first position to the sealed position when the door sweep 112 is in the second position for preventing infiltration of the fluid from the exterior 24 to the interior 26 of the structure 22.

The seal 102 extends over and covers the channel 98 in the initial position when the door sweep 112 is in the first position. The seal 102 at least partially uncovers the channel 98 in the sealed position such that the distal end 103 of the seal 102 is positioned above the channel 98 when the door sweep 112 is in the second position for directing any fluid that may infiltrate between the door sweep 112 and the seal 102 off the downwardly extending seal 102 at the distal end 103 and into the channel 98.

As shown in FIG. 1, the threshold assembly 40 may be disposed between the first and second door jambs 30, 32. The threshold assembly 40 may be disposed below the door panel 38 such that the threshold assembly 40 is disposed within the opening 34 opposite the door head 36 and extending toward each of the first and second door jambs 30, 32. It is to be appreciated that the threshold assembly 40 may be disposed anywhere within the opening 34.

As shown in FIG. 1, the sill 42 may extend between a first end 48 and a second end 50. Although not explicitly shown in FIGS. 2, 3, 7, and 8, it is to be appreciated that the extension of the sill 42 to the second end 50 as described below is similar to the extension of the sill 42 to the first end 48 as shown in FIGS. 2, 3, 7, and 8. Typically, the first end 48 of the sill 42 is adjacent the first door jamb 30 and the second end 50 is adjacent the second door jamb 32. More typically, the first end 48 abuts the first door jamb 30 and the second end 50 abuts the second door jamb 32. However, it is to be appreciated that one or both of the first and second ends 48, 50 may be spaced from the first and second door jambs 30, 32, respectively.

As shown in FIGS. 2-5 and 7-11, the sill 42 may comprise numerous components. Specifically, as shown in the Figures, the sill 42 may include a sill base 56, a sill deck 58 disposed above and coupled to the sill base 56, and a rail 72. The sill base 56 may have a nosing 60 extending upwardly toward the door sweep 112 in the second position. In another embodiment, the sill 42 may further include the nosing 60 as an independent component, as shown in FIGS. 7-11. Although not shown in the Figures, the sill 42 may be a one-piece sill 42 which comprises a single component. It is to be appreciated that the sill 42 may comprise any number of components.

As shown in FIGS. 2, 3, 7, and 8, the sill 42 has a tread surface 52 adjacent the exterior side 44 and extending toward the interior side 46 with the tread surface 52 sloped downwardly away from the interior side 46 of the sill 42 for positively draining the fluid off of the sill 42. More specifically, when present, the sill deck 58 may have the tread surface 52. The slope of the tread surface 52 promotes positive drainage of the fluid that may contact the tread surface 52. Said differently, the slope of the tread surface 52 directs the fluid from the threshold assembly 40 toward the exterior 24 of the structure 22. Positive drainage typically refers to a desired drainage path of the fluid whereas negative drainage typically refers to an undesired drainage path of the fluid. For example, positive drainage is the movement of the fluid away from the interior 26 of the structure 22 and toward the exterior 24 of the structure 22, and negative drainage is the movement of the fluid away from the exterior 24 of the structure 22 and toward the interior 26 of the structure 22.

As set forth in the present application, the term drainage typically refers to movement of the fluid. However, it is to be appreciated that the drainage may refer to the movement of any fluid, including any debris that may be entrapped within the fluid. Furthermore, drainage may also refer to the movement of any object that is desired to be removed from the threshold assembly 40.

The tread surface 52 may also define a plurality of grooves 54 spaced from and parallel to one another and extending longitudinally along the sill 42. The grooves 54 collect and direct the fluid, which poses a slipping hazard to a person stepping on the tread surface 52.

As shown in FIGS. 4, 5, and 9-11, the sill 42 may have a dam 68 adjacent the tread surface 52 and extending upwardly toward the door sweep 112 for blocking backflow of the fluid across the tread surface 52 of the sill 42 and into the interior 26 of the structure 22. When present, the sill deck 58 may have the dam 68. As set forth in the present application, the term "backflow" refers to a type of negative drainage. As an example, backflow is when the fluid is forced from the exterior side 44 of the sill 42 toward the interior side 46 of the sill 42. Such backflow may occur due to wind forcing the fluid up the tread surface 52.

Typically, the dam 68 extends longitudinally between the first and second door jambs 30, 32. The dam 68 extends into the opening 34 and blocks backflow of the fluid across the tread surface 52 of the sill 42 and into the interior 26 of the structure 22.

As shown in FIGS. 1-5 and 7-11 and described above, the sill 42 may include the rail 72. The rail 72 typically extends entirely between the first and second ends 48, 50. It is to be appreciated that the rail 72 may be spaced from one or both of the first and second ends 48, 50. It is also to be appreciated that the rail 72 may extend past the sill deck 58 or the sill base 56 such that the rail 72 defines one or both of the first and second ends 48, 50 of the sill 42. The rail 72 is typically spaced from each of the first and second door jambs 30, 32. However, the rail 72 may extend to and contact one or both of the first and second door jambs 30, 32.

As described above, the sill 42 may include the sill deck 58, with the rail 72 disposed above the sill deck 58. Typically, portions of the sill deck 58 and the sill base 56 are disposed beneath the rail 72. Said differently, the sill deck 58 and the sill base 56 extend out from underneath the rail 72. The rail 72 may have a pair of walls 76 extending downwardly toward the sill deck 58. The pair of walls 76 is spaced from and substantially parallel to one another. The pair of walls 76 may extend entirely along the sill 42 between the first and second ends 48, 50. However, it is to be appreciated that the pair of walls 76 may extend along only a portion of the sill 42.

As shown in FIGS. 4, 5, and 9-11, the sill deck 58 may define the dam 68 extending between the pair of walls 76 of the rail 72 to couple the rail 72 to the sill deck 58. Said differently, the dam 68 extends between the walls 76 and abuts the rail 72 at an end. The engagement of the dam 68 with the rail 72 prevents excessive flexing if a load is applied to the rail 72 downwardly toward the sill 42.

The pair of walls 76 is typically spaced from the dam 68. When a load is applied to the rail 72 toward the exterior or interior sides 44, 46 of the sill 42, one of the pair of walls 76 moves into engagement with the dam 68. The engagement of the one of the pair of walls 76 with the rail 72 when the load is applied to the rail 72 toward the exterior or interior sides 44, 46 of the sill 42, prevents excessive flexing of the rail 72 toward the exterior or interior sides 44, 46. It is to be appreciated that one and/or both of the pair of walls 76 may be in constant engagement with the dam 68.

One of the pair of walls 76 may have a protrusion 78 extending in a first direction. Typically, the first direction is further defined as the protrusion 78 extending toward the interior side 46 of the sill 42. The dam 68 may have a hump 80 extending in a second direction opposing the first direction. Typically, the second direction is further defined as the hump 80 extending toward the exterior side 44 of the sill 42. The hump 80 is adjacent to the protrusion 78. More specifically, the hump 80 is disposed between the protrusion 78 and the end of the dam 68. The protrusion 78 and the hump 80 selectively engaging as the rail 72 translates away from the sill deck 58 to retain the coupling of the rail 72 with the sill deck 58. Although the protrusion 78 extends in the first direction which is typically toward the interior side 46 of the sill 42 and the hump 80 extends in the second direction which is typically toward the exterior side 44 of the sill 42, it is to be appreciated that the protrusion 78 may extend from the other one of the pair of walls 76 toward the exterior side 44 of the sill 42 and the hump 80 may extend toward the interior side 46 of the sill 42. Moreover, it is to be appreciated that the protrusion 78 and the hump 80 may be any configuration for retaining the coupling of the rail 72 with the sill 42.

As shown in FIGS. 4, 5, and 9-11, the rail 72 may have an apex 96. The apex 96 is a portion of the rail 72 closest to the door sweep 112 when the door panel 38 is in the closed position.

The sill 42 may have a primary surface 92 adjacent the seal 102 and sloping downwardly away from the interior side 46 of the sill 42 for positively draining the fluid away from the seal 102 toward the exterior side 44 of the sill 42. More specifically, when present, the rail 72 has the primary surface 92. The primary surface 92 extends between the pair of walls 76 and the apex 96, with the primary surface 92 primarily facing the opening 34. The slope of the primary surface 92 downwardly away from the interior side 46 of the sill 42 provides positive drainage off of the rail 72 toward the exterior side 44 of the sill 42. More specifically, the primary surface 92 extends from the apex 96 downwardly toward the exterior side 44 of the sill 42 which promotes positive drainage off of the rail 72 toward the tread surface 52.

The sill 42 may define a slot 94 below the apex 96. In one embodiment shown in FIGS. 4 and 5, the sill deck 58 of the sill 42 defines the slot 94. In another embodiment shown in FIGS. 9-11, the rail 72 of the sill 42 defines the slot 94. The slot 94 opens toward the interior side 46 of the sill 42. The slot 94 may be defined entirely along the sill 42 between the first and second ends 48, 50. However, it is to be appreciated that the slot 94 may be defined along only a portion of the sill 42.

As shown in FIGS. 4, 5, and 9-11, the sill 42 may have an engagement surface 88. Typically, the rail 72 has the engagement surface 88; however, it is to be appreciated that any portion of the sill 42 may have the engagement surface 88. The engagement surface 88 typically extends down from the apex 96. The engagement surface 88 may define a projection 90. The projection 90 typically extends toward the interior side 46 of the sill 42. It is to be appreciated that the projection 90 may extend in any suitable direction. The engagement surface 88 and the projection 90 will be better understood through further description below.

Figure 9:
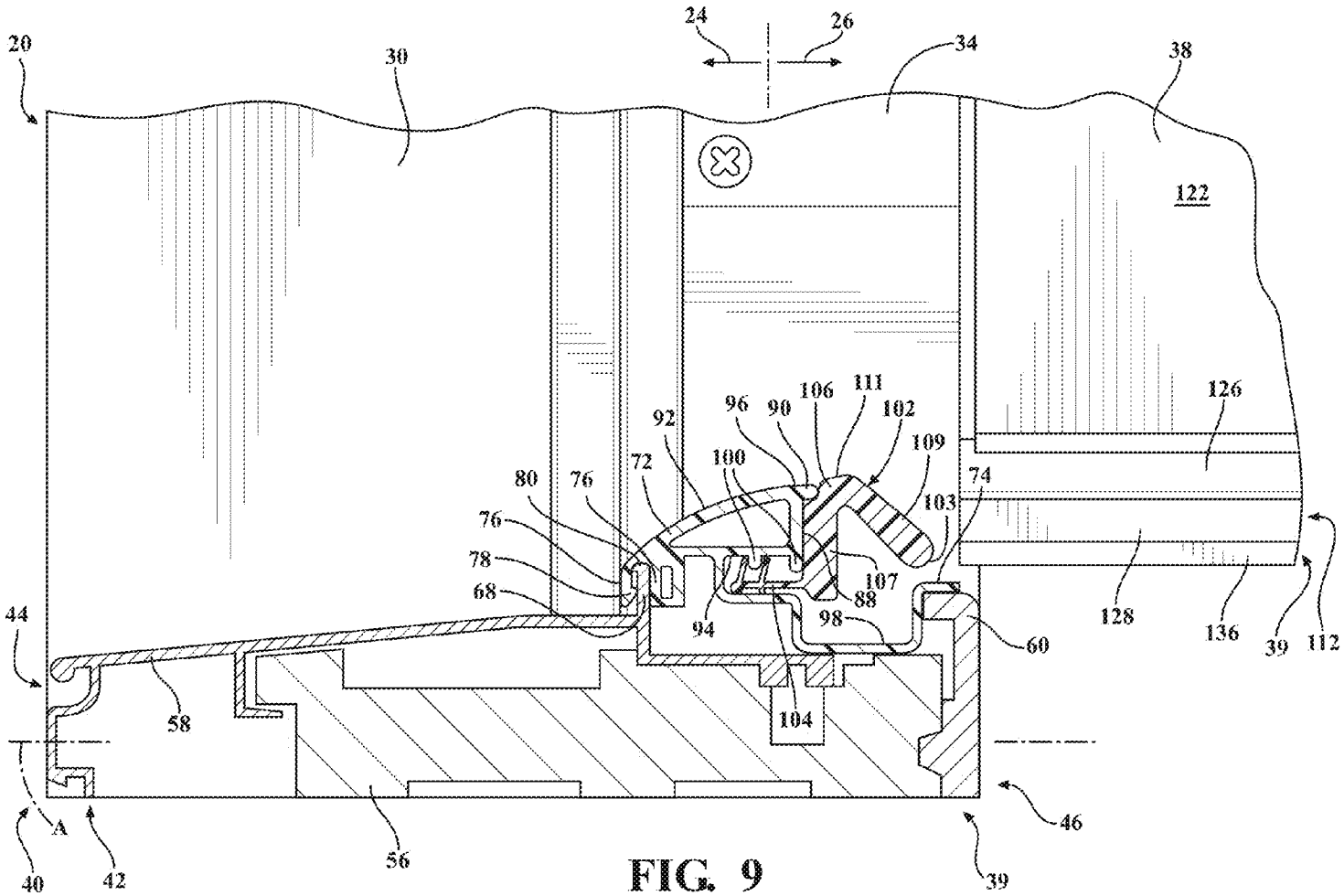
FIG. 9 is a cross-sectional view of the door bottom system shown in FIG. 7 and showing the seal in the initial position and the door panel in the open position.
Figure 10:
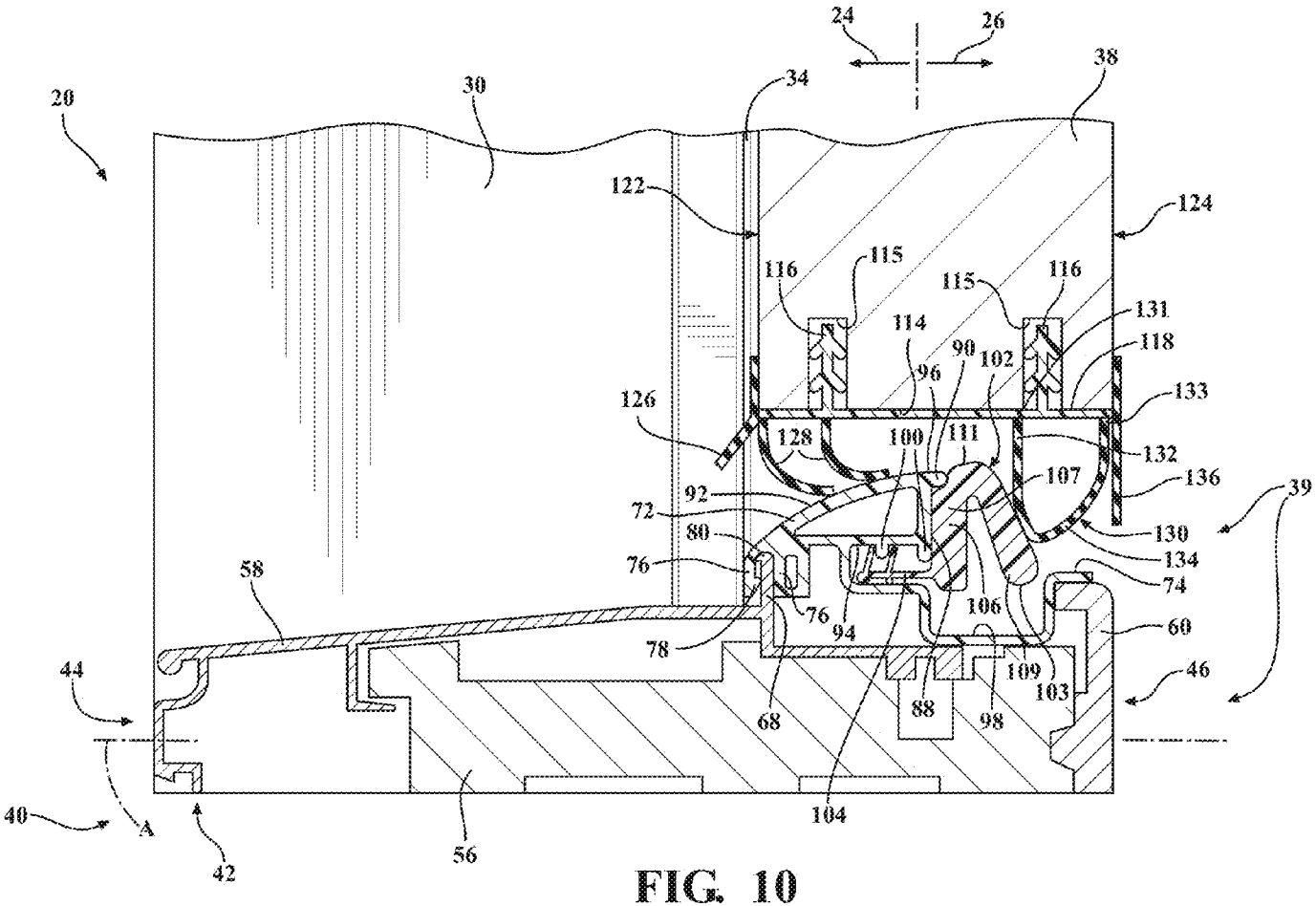
FIG. 10 is a cross-sectional view of the door bottom system shown in FIG. 7 and showing the seal in the sealed position and the door panel in the closed position.
Figure 11:
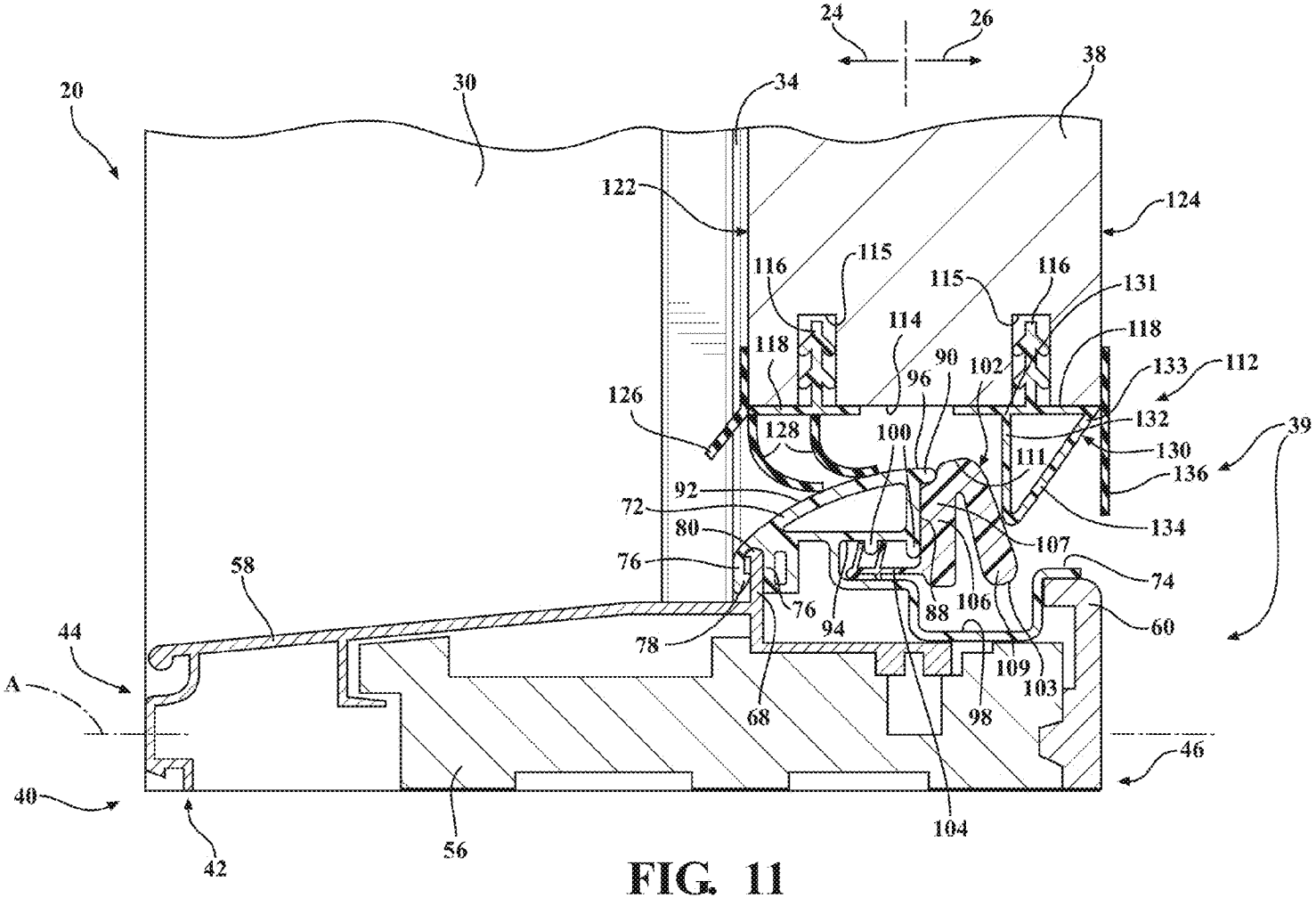
FIG. 11 is a cross-sectional view of another embodiment of the door bottom system showing the seal in the sealed position and the door panel in the closed position.

As shown in FIGS. 9-11, the sill 42 may include at least one protuberant 100 extending into the slot 94. In one embodiment, the rail 72 of the sill 42 has the at least one protuberant 100. It is to be appreciated that when the slot 94 is defined by the sill deck 58, the sill deck 58 may have the at least one protuberant 100. The at least one protuberant 100 may be defined entirely along the sill 42 between the first and second ends 48, 50. However, it is to be appreciated that the at least one protuberant 100 may be defined along only a portion of the sill 42. The slot 94 and the at least one protuberant 100 will be better understood through further description below.

As shown in FIGS. 2-5 and 7-11 and as described above, the sill 42 defines the channel 98 between the exterior side 44 and the interior side 46 which is adapted for accepting a fluid therein. The channel 98 typically extends longitudinally between the first and second ends 48, 50 of the sill 42. The channel 98 opens into the opening 34. In one embodiment shown in FIGS. 4 and 5, each of the sill deck 58 and the nosing 60 at least partially define the channel 98. More specifically, in this embodiment the sill deck 58 and the sill base 56 (which includes the nosing 60) defines the channel 98. In another embodiment shown in FIGS. 9-11, the rail 72 may define the channel 98 between the dam 68 and the nosing 60. It is to be appreciated that any portion of the sill 42 may define the channel 98.

Referring now to FIGS. 2-5 and 7-11, the portion of the sill 42 defining the channel 98 may be solid to retain the fluid in the channel 98. When the fluid is retained in the channel 98, the fluid may leave the channel 98 by evaporation. Alternatively, the portion of the sill 42 defining the channel 98 may have a weeping device within the channel 98 to facilitate passage of the fluid from the channel 98 to the sill 42. As one example, the weeping device may be a plurality of bores extending through the sill 42. As another example, the weeping device may be a fluid-permissible membrane. It is to be appreciated that the weeping device may be any configuration for allowing the fluid to pass from the channel 98 through the sill 42. Although not shown, the sill 42 may define a plurality of passages between the channel 98 and the exterior side 44 of the sill 42 to facilitate positive drainage of the fluid from the channel 98.

When the rail 72 defines the channel 98 as shown in FIGS. 9-11, the rail 72 may have a lip 74 extending toward the interior side 46 of the sill 42, with the lip 74 abutting the nosing 60. The lip 74 may abut the nosing 60 entirely along the sill 42 between the first and second ends 48, 50. However, it is to be appreciated that the lip 74 may abut the nosing 60 along only a portion of the sill 42. The engagement of the lip 74 with the nosing 60 prevents excessive flexing if a load is applied downwardly to the rail 72.

As described above, the threshold assembly 40 further includes the seal 102. As shown in FIGS. 2, 3, 7, and 8, the seal 102 extends along the rail 72 toward the first and second door jambs 30, 32. The seal 102 may be disposed along the entirety of the sill 42. It is to be appreciated that the seal 102 may be disposed along a portion of the sill 42. Furthermore, the seal 102 may be segmented such that the seal 102 is disposed along portions of the sill 42. The seal 102 is typically disposed entirely under the door sweep 112 when the door sweep 112 is in the second position; however, it is to be appreciated that at least a portion of the seal 102 may not be disposed under the door sweep 112 when the door sweep 112 is in the second position.

As shown in FIGS. 4, 5, and 9-11, the seal 102 may have a stem 104 and a body 106 coupled to one another with the stem 104 disposed in the slot 94 and the body 106 extending toward the interior side 46 of the sill 42. The stem 104 frictionally engages the sill 42 within the slot 94 to couple the seal 102 to the sill 42. When present, the stem 104 may engage the at least one protuberant 100 to retain the stem 104 in the slot 94 and couple the seal 102 to the rail 72, as shown in FIGS. 9-11.

As shown in FIGS. 4, 5, and 9-11, the seal 102 may have a first portion 107 and a second portion 109 with the first portion 107 extending upwardly toward the door sweep 112 to a seal juncture 111, and the second portion 109 extending from the seal juncture 111 the downwardly toward the distal end 103 of the seal 102. More specifically, the body 106 may have the first portion 107 and the second portion 109.

The engagement surface 88 of the sill 42 extends substantially parallel to the first portion 107 of the seal 102 with the first portion 107 abutting the sill 42 along the engagement surface 88 for preventing intrusion of the fluid between the sill 42 and the seal 102. Furthermore, the projection 90 of the engagement surface 88 extends toward the first portion 107 of the seal 102 to deflect the first portion 107 along the projection 90 and further seal between the sill 42 and the seal 102. Typically, the first portion 107 of the seal 102 is substantially perpendicular to the axis A. It is to be appreciated that the first portion 107 of the seal 102 may extend upwardly to the seal juncture 111 at any suitable angle and in any suitable configuration.

Figure 4:
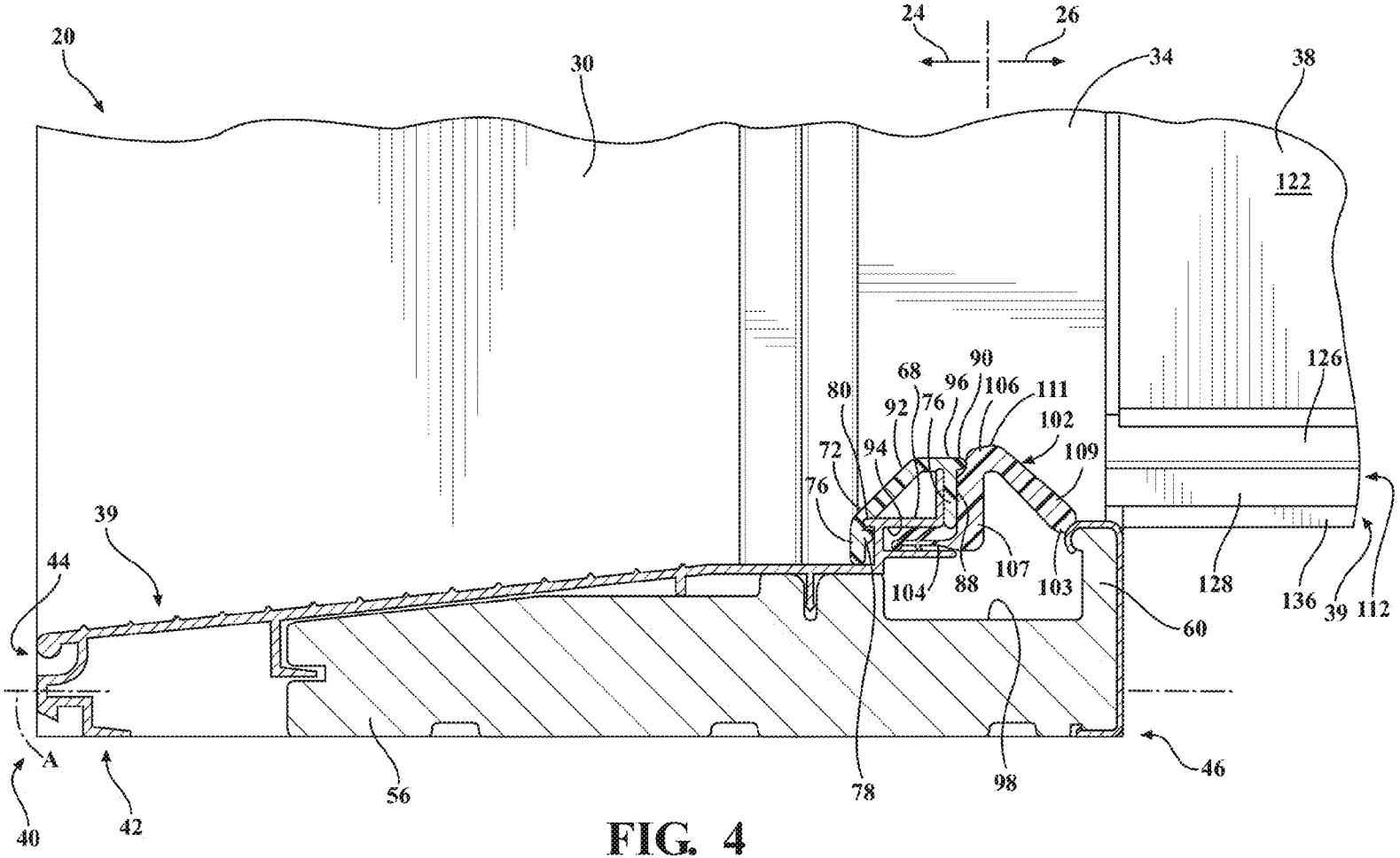
FIG. 4 is a cross-sectional view of the door bottom system taken along 2-2 shown in FIG. 1, and showing a seal in an initial position and a door panel in an open position.
Figure 5:
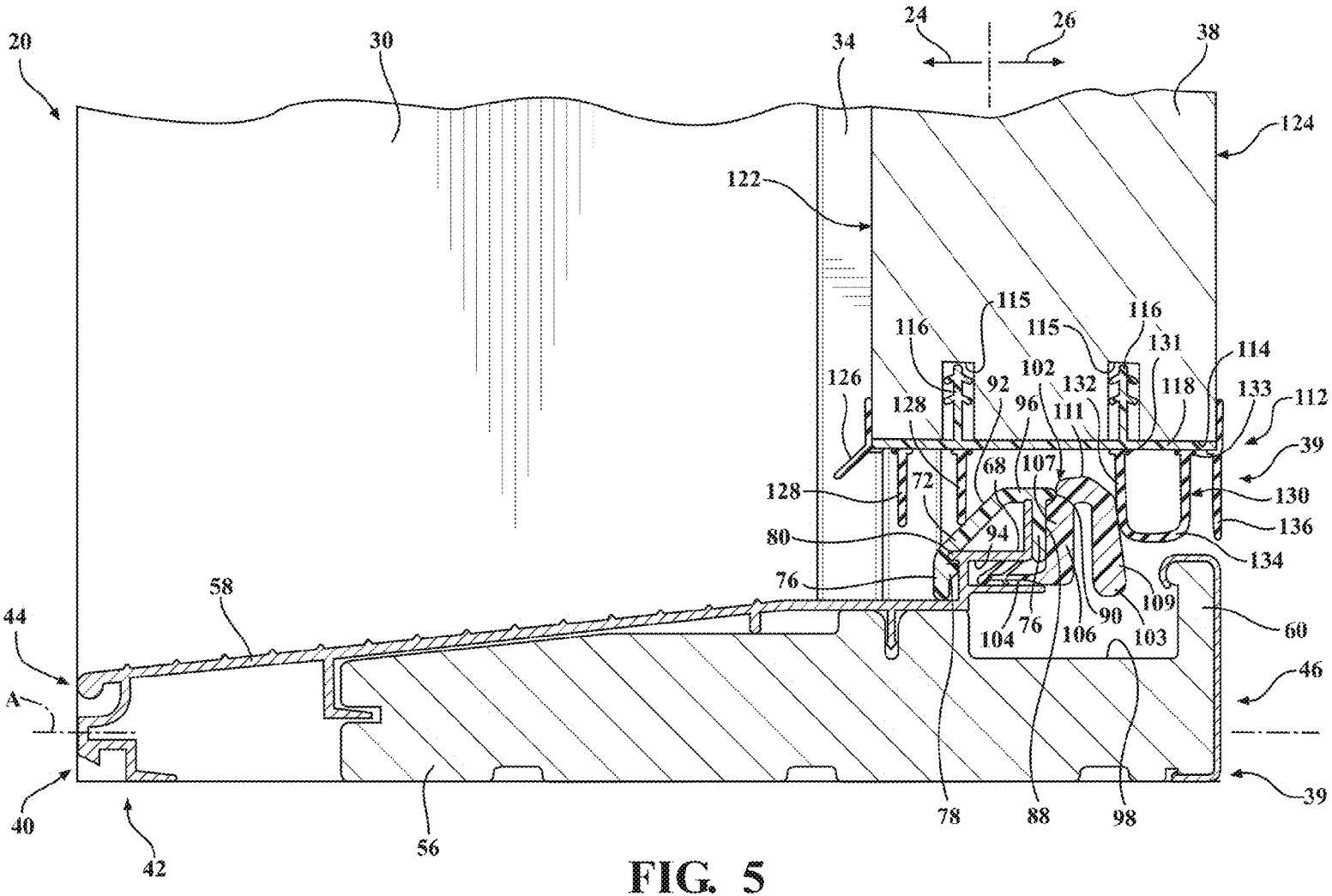
FIG. 5 is a cross-sectional view of the door bottom system shown in FIG. 2 and showing the seal in a sealed position and the door panel in a closed position.

The second portion 109 extends downwardly at an angle from the first portion 107 in the initial position of the seal 102 as shown in FIGS. 4 and 9. It is to be appreciated that the second portion 109 may extend downwardly at any suitable angle.

As shown in FIGS. 4, 5, and 9-11, the seal 102 may extend toward the nosing 60 with the at least a portion of the distal end 103 of the seal 102 disposed above the nosing 60 in the initial position such that the seal 102 extends over and covers the channel 98 when the door sweep 112 is in the first position. In one embodiment shown in FIGS. 4 and 5, the seal 102 may extend to and engage the nosing 60 at the distal end 103 in the initial position such that the seal 102 extends over and covers the channel 98 when the door sweep 112 is in the first position. It is to be appreciated that the distal end 103 of the seal 102 may be positioned in any suitable location such that the seal 102 covers the channel 98 in the initial position when the door sweep 112 is in the first position.

The seal 102 generally moves from the interior side 46 of the sill 42 toward the exterior side 44 of the sill 42 as the seal 102 moves from the initial position, shown in FIGS. 4 and 9, to the sealed position, shown in FIGS. 5, 10, and 11. The seal 102 typically comprises a flexible foamed urethane with a vinyl jacket. However it is to be appreciated that the seal 102 may be any other material of suitable flexibility.

The seal 102 may be internally biased toward the initial position. It is to be appreciated that the seal 102 may be biased toward the initial position by way of any suitable configuration, such as a biasing member coupled to the second portion 109 of the seal 102 and biasing the seal 102 to the initial position.

Figure 12:
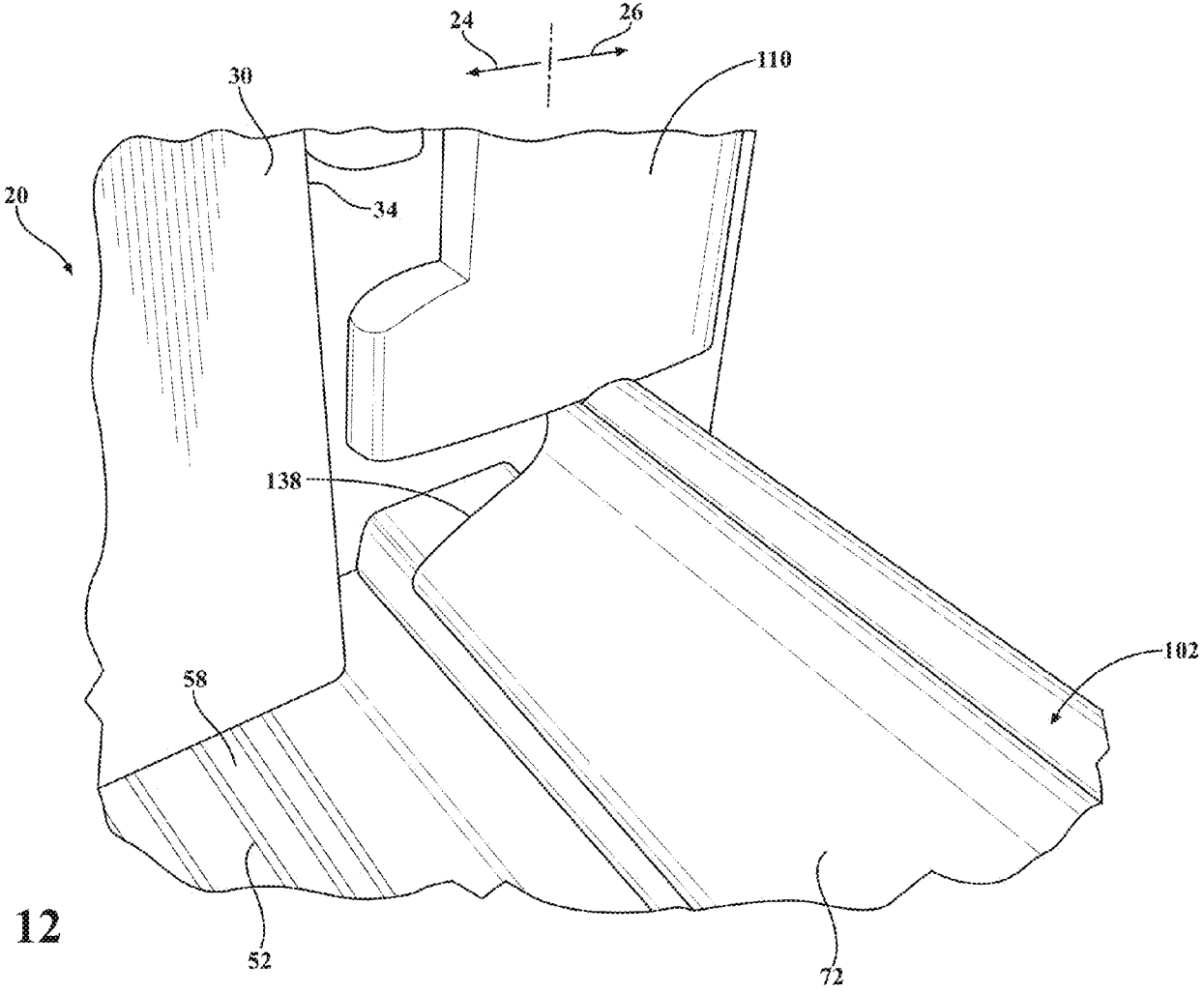
FIG. 12 is a perspective view of the threshold assembly including a sill defining a notch.

As shown in FIG. 12, the entryway system 20 may include a pair of cornerpads 110 individually disposed on the door jambs 30, 32 adjacent the ends 50, 52 and abutting the seal 102 for sealing the opening 34 of the door frame 28 between the door jambs 30, 32 and the seal 102. Although only illustrated in the FIG. 12 disposed on the first door jamb 30, it is to be appreciated that each cornerpad 110 independently abuts one of the door jambs 30, 32 and the seal 102 to seal between the seal 102 and the door jambs 30, 32 and prevent intrusion of the fluid into the interior 26 of the structure 22.

The sill 42 may further define a pair of notches 138 individually formed at opposing ends of the sill 42, as shown in FIG. 12. When present, the rail 72 defines the pair of notches 138. The cornerpads 110 are at least partially disposed above the notches 138. Fluid that collects on the cornerpads 110 and/or the primary surface 92 of the sill 42 adjacent the notches 138 moves into the notches 138. The configuration of the notches 138 directs the fluid toward the exterior side 44 of the sill 42 for positively draining the fluid away from the threshold assembly 40 to further prevent the fluid from permeating between the door panel 38 and at least one of the rail 72 and the cornerpads 110.

As described above and shown in FIGS. 2-5 and 7-11, the door sweep 112 is disposed below and adapted to be coupled to the door panel 38, with the door sweep 112 movable between first and second positions corresponding with the open and closed positions of the door panel 38, respectively. The door sweep 112 selectively engages and moves the seal 102 from the initial position when the door sweep 112 is in the first position (shown in FIGS. 2-4 and 7-9) to the sealed position when the door sweep 112 is in the second position (shown in FIGS. 5, 10, and 11). Although not shown, it is to be appreciated that the movement of the seal 102 between the initial position and the sealed position may be accomplished with or without the door sweep 112 present.

As shown in at FIGS. 2, 3, 7, and 8, the door sweep 112 is typically disposed longitudinally along, and coupled to, a lower surface 114 of the door panel 38. The door sweep 112 may include a sweep frame 118 adapted to be coupled to the door panel 38. The sweep frame 118 may extend longitudinally along the lower surface 114 of the door panel 38. Typically, the sweep frame 118 extends longitudinally along the entirety of the lower surface 114; however, it is to be appreciated that the sweep frame 118 may extend longitudinally along a portion of the lower surface 114. Generally, the sweep frame 118 extends to an outside surface 122 of the door panel 38 facing the exterior 24 of the structure 22 when the door panel 38 is in the closed position and to an inside surface 124 of the door panel 38 facing the interior 26 of the structure 22 when the door panel 38 is in the closed position, as shown in FIGS. 5, 10, and 11.

As best shown in FIGS. 5, 10, and 11, the lower surface 114 of the door panel 38 may define at least one kerf 115. Typically, the at least one kerf 115 extends inwardly from the lower surface 114. Further, typically the at least one kerf 115 is defined longitudinally along the door panel 38. It is to be appreciated that the at least one kerf 115 defined by the door panel 38 may comprise a plurality of kerfs 115. Additionally, the door sweep 112 may include at least one leg 116 coupled to and extending from the sweep frame 118 of the door sweep 112 toward the door panel 38 for engaging the door panel 38 within the kerf 115 or kerfs 115. The at least one leg 116 extends longitudinally along the lower surface 114 of the door panel 38. Generally, engagement of the leg 116 with the door panel 38 within the at least one kerf 115 couples the door sweep 112 to the door panel 38. However, it is to be appreciated that the door sweep 112 may be coupled to the door panel 38 by any suitable method.

The door sweep 112 may include an outside seal 126. The outside seal 126 may extend longitudinally along the lower surface 114 of the door panel 38. Typically, the outside seal 126 extends longitudinally along the entirety of the lower surface 114; however, it is to be appreciated that the outside seal 126 may extend longitudinally along a portion of the lower surface 114. The outside seal 126 may extend angularly from the sweep frame 118 adjacent to the outside surface 122 away from the door panel 38 and toward the exterior side 44 of the sill 42. The outside seal 126 positively drains the fluid off of the outside surface 122 of the door panel 38 to prevent the infiltration of the fluid between the door panel 38 and the sill 42.

The door sweep 112 may include a flap 136 extending from the sweep frame 118 toward the sill 42. The flap 136 may cover a gap between the sweep frame 118 and the sill 42. More specifically, the flap 136 may cover the gap between the sweep frame 118 and the nosing 60. The flap 136 may extend longitudinally along the lower surface 114 of the door panel 38. Typically, the flap 136 extends longitudinally along the entirety of the lower surface 114; however, it is to be appreciated that the flap 136 may extend longitudinally along a portion of the lower surface 114. The flap 136 may be substantially coplanar with the interior side 46 of the sill 42 when the door panel 38 is in the completely closed position. The flap 136 may further seal between the door panel 38 and the sill 42 to prevent negative drainage of the fluid toward the interior side 46 of the sill 42. Furthermore, the flap 136 may create an aesthetic transition between the door panel 38 and the sill 42.

Figure 3:
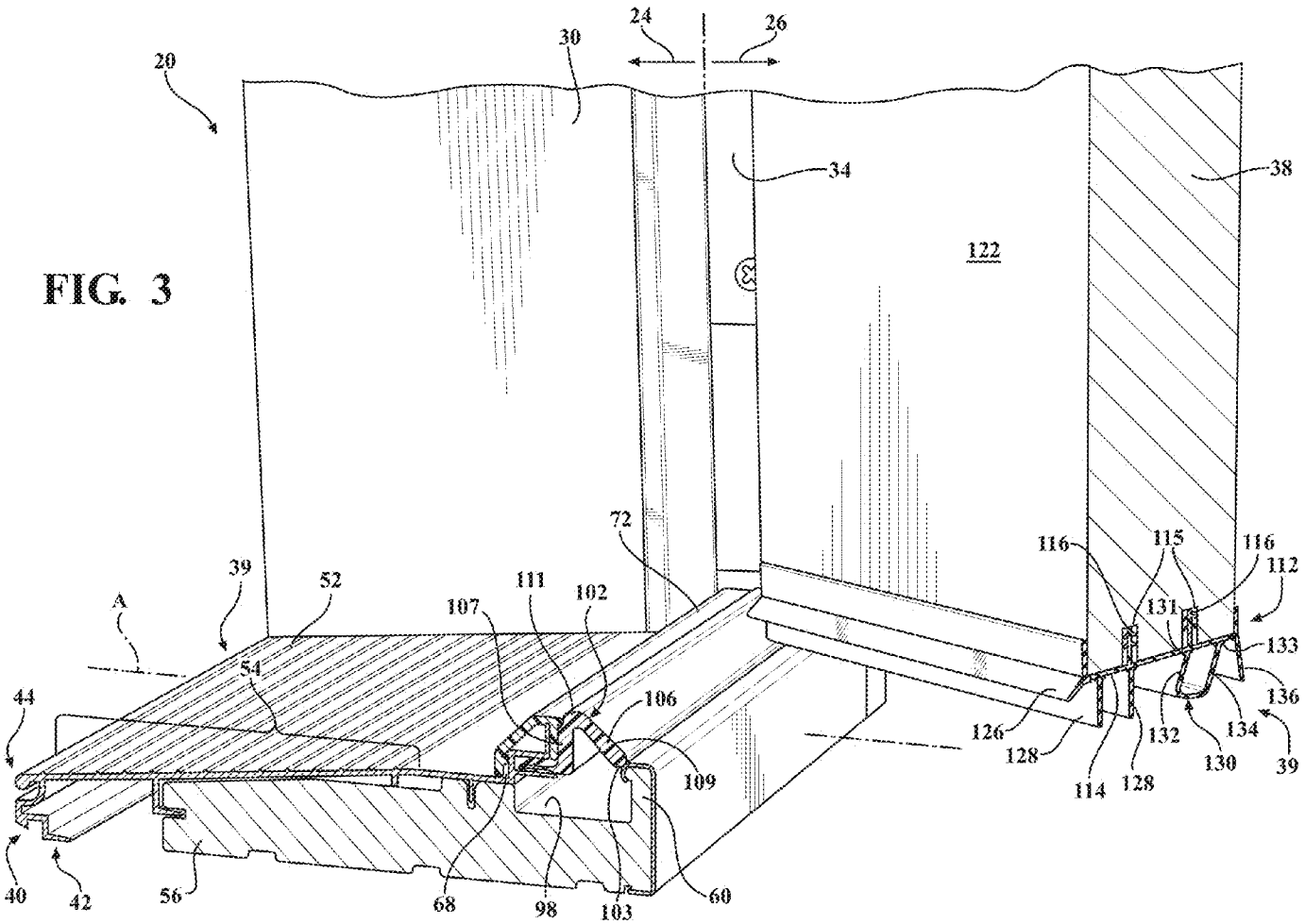
FIG. 3 is a cross-sectional perspective view of a portion of the entryway system taken along 3-3 shown in FIG. 1, and showing the cross-section of the door bottom system and including the threshold assembly and the door sweep, shown relative to an interior side of the threshold assembly.
Figure 8:
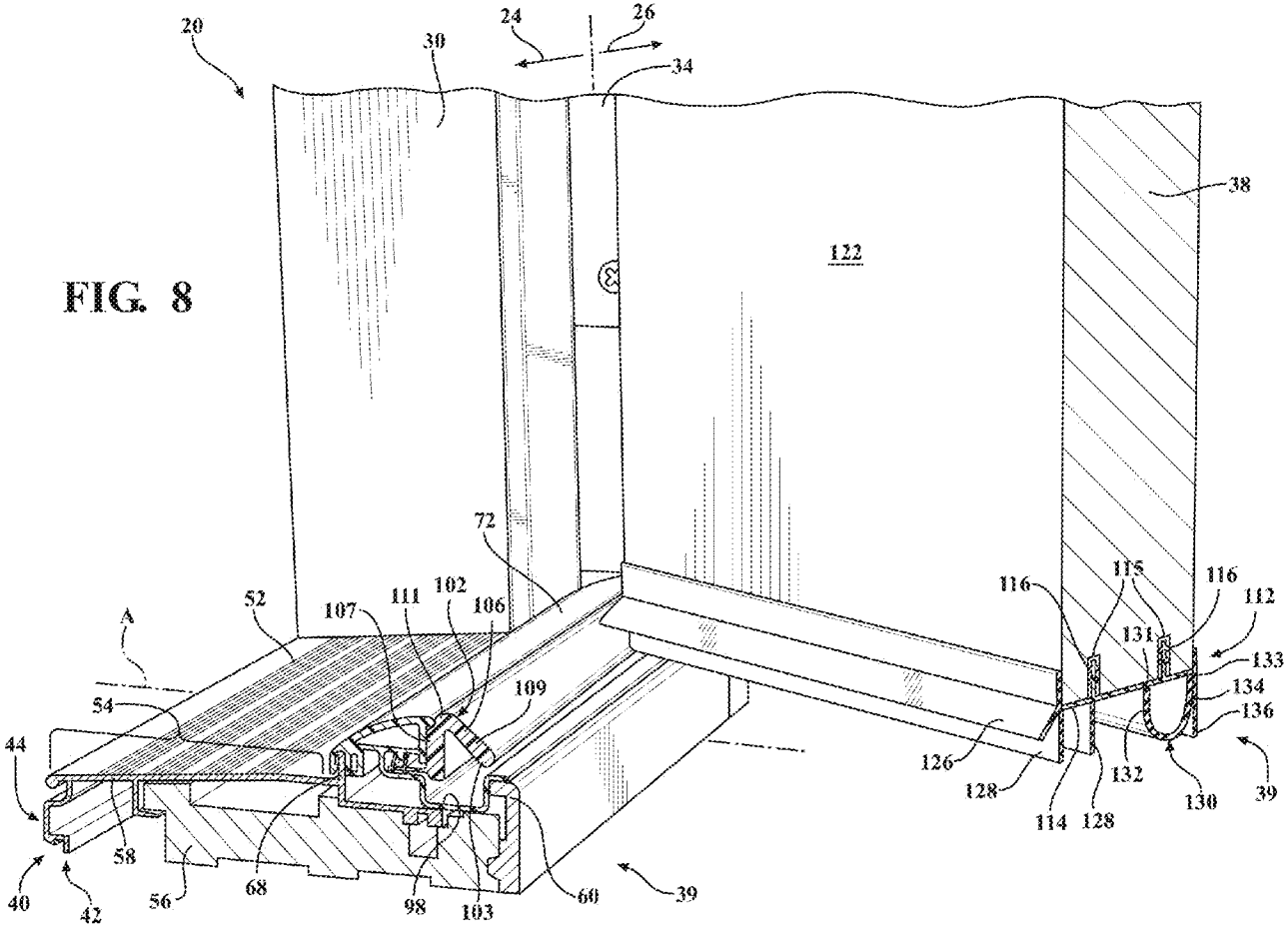
FIG. 8 is a cross-sectional perspective view of the portion of the entryway system showing the cross-section of the door bottom system shown in FIG. 7 and including the threshold assembly and the door sweep, shown relative to the interior side of the threshold assembly.

The door sweep 112 may include at least one fin 128 extending downwardly toward the sill 42 in a substantially linear configuration in the first position of the door sweep 112 and the open position of the door panel 38, as best shown in FIGS. 3 and 8. More specifically, the at least one fin 128 typically extends downwardly from the sweep frame 118 toward the sill 42. The at least one fin 128 may extend longitudinally along the lower surface 114 of the door panel 38. Typically, the at least one fin 128 extends longitudinally along the entirety of the lower surface 114; however, it is to be appreciated that the at least one fin 128 may extend longitudinally along a portion of the lower surface 114.

As shown in FIGS. 5, 10, and 11, the at least one fin 128 may abut along the primary surface 92 of the sill 42 to seal against the primary surface 92 of the sill 42 and prevent backflow of the fluid over the sill 42, which would result in negative drainage off of the rail 72 toward the interior side 46 of the sill 42. The abutment of the at least one fin 128 with the primary surface 92 of the sill 42 may be further defined as the at least one fin 128 flexing such that a portion of the at least one fin 128 lies along and seals against the primary surface 92. It is also to be appreciated that the at least one fin 128 may be spaced from the primary surface 92 with the at least one fin 128 blocking a majority of the fluid from passing between the door panel 38 and the sill 42 toward the interior side 46 of the sill 42, and facilitating drainage of the fluid off of the outside surface 122 of the door panel 38 toward the rail 72 for positive drainage off of the sill 42.

Typically, the at least one fin 128 is further defined as a pair of fins 128. It is to be appreciated that the at least one fin 128 may be a single fin 128 or any number of fins 128.

When the pair of fins 128 is present, the fins 128 are typically spaced from one another and positioned toward the outside surface 122 of the door panel 38. It is to be appreciated that the pair of fins 128 may be adjacent to one another. As shown in FIGS. 5, 10, and 11, both of the pair of fins 128 abut the primary surface 92. It is to be appreciated that the one of the pair of fins 128 may be spaced from the primary surface 92 while the other one of the pair of fins 128 may abut the primary surface 92. Furthermore, it is to be appreciated that both of the pair of fins 128 may be spaced from the primary surface 92.

As shown in FIGS. 3 and 8, the door sweep 112 may include an engagement member 130 extending from the sweep frame 118 toward the sill 42 with the engagement member 130 extending along and abutting at least a portion of the seal 102 in the second position of the door sweep 112 (operatively shown in FIGS. 5, 10, and 11). The engagement member 130 may extend longitudinally along the lower surface 114 of the door panel 38. Typically, the engagement member 130 extends longitudinally along the entirety of the lower surface 114; however, it is to be appreciated that the engagement member 130 may extend longitudinally along a portion of the lower surface 114.

Figure 6:
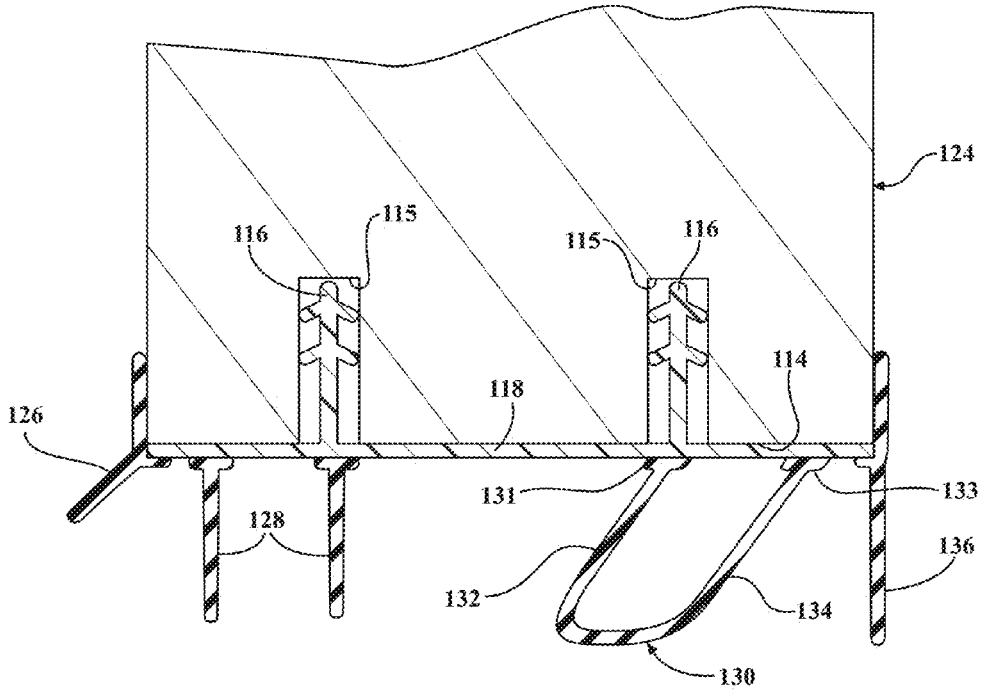
FIG. 6 is a cross-sectional view of the door sweep taken along 2-2 shown in FIG. 1, in a first position.
Figure 7:
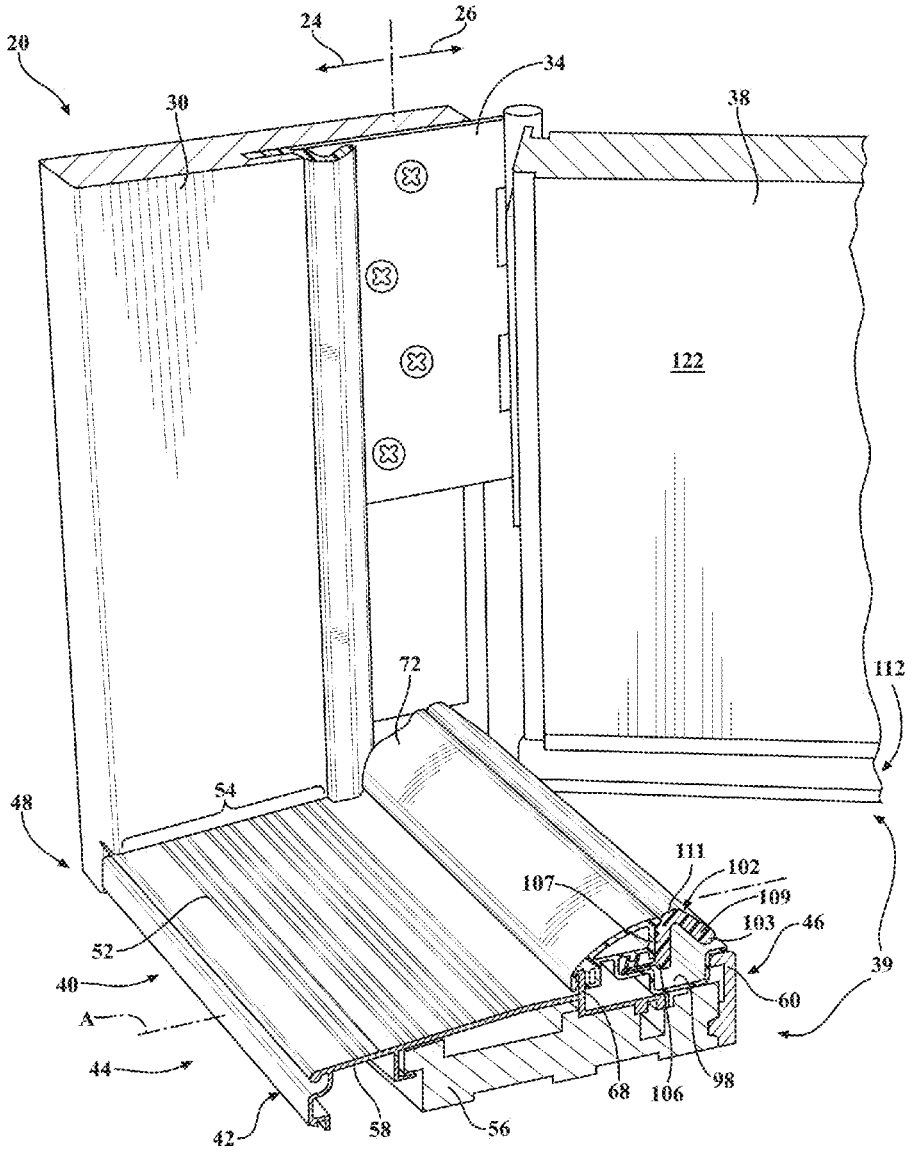
FIG. 7 is a cross-sectional perspective view of a portion of the entryway system showing a cross-section of another embodiment of the door bottom system including the threshold assembly and the door sweep, shown relative to the exterior side of the threshold assembly.

As best shown in FIGS. 5, 10, and 11, the engagement member 130 extends between exterior and interior ends 131, 133, with the engagement member 130 having a first section 132 extending from the exterior end 131 and a second section 134 extending from the interior end 133. Each of the first and second sections 132, 134 extend downwardly from the sweep frame 118 toward the sill 42 and interconnect at a position spaced from the sweep frame 118. With the door panel 38 in the open position and the door sweep 112 in the first position, the first section 132 may have a substantially linear configuration as shown in FIGS. 3 and 8. In one embodiment shown in FIGS. 3 and 6, the first section 132 extends downwardly in the substantially linear configuration at an angle toward the exterior side 44 of the sill 42. In another embodiment shown in FIGS. 8 and 11, the first section 132 extends downwardly substantially perpendicular to the axis in the substantially linear configuration. The second section 134 may have an arcuate configuration as shown in FIGS. 3, 6, and 8. Alternatively, the second section 134 may have a linear configuration as shown in FIG. 11. It is to be appreciated that the first section 132 may have an arcuate configuration or any other suitable configuration. Furthermore, the second section 134 may have any other suitable configuration.

As shown in FIGS. 5, 10, and 11, the engagement member 130 engages the seal 102 when the door panel 38 is in the closed position and the door sweep 112 is in the second position. More specifically, the first section 132 of the engagement member 130 engages the second portion 109 of the seal 102 and moves the seal 102 into the sealed position. Furthermore, the first section 132 of the engagement member 130 may be deflected in the second position of the door sweep 112 as the first section 132 abuts along the portion of the seal 102, as shown in FIGS. 5 and 10. Said differently, the first section 132 of the engagement member 130 flexes toward the inside surface 124 of the door panel 38. The second section 134 of the engagement member 130 may bias the first section 132 of the engagement member 130 toward the seal 102 in the second position of the door sweep 112. More specifically, the second section 134 of the engagement member 130 may bias the first section 132 toward the seal 102, with the seal 102 simultaneously biasing the second portion 109 toward the engagement member 130. As such, the engagement of the engagement member 130 with the second portion 109 of the seal 102 causes both the movement of the seal 102 into the sealed position and the deflection of the engagement member 130, with the second portion 109 of the seal 102 and the first section 132 of the engagement member 130 abutting and sealing against one another over a greater surface area to prevent negative drainage of the fluid toward the interior 26 of the structure 22. As shown in FIG. 11, the engagement member 130 may be rigid such that engagement member 130 does not flex or minimally flexes when the engagement member 130 engages the seal 102. However, it is to be appreciated that the configuration of the engagement member 130 shown in FIG. 11 may at least partially comprise a flexible material allowing the engagement member 130 to flex upward toward the door panel 38. As a non-limiting example, the entire engagement member 130 shown in FIG. 11 may comprise the flexible material. As another non-limiting example, the first section 132 of the engagement member 130 shown in FIG. 11 may comprise the flexible material and the second section 134 may be rigid and capable of articulating relative to the sweep frame 118. It is to be appreciated that any portion of the engagement member 130 shown in FIGS. 3, 5, 6, 8, 10, and 11 may comprise the flexible material. Furthermore, the use of the flexible material anywhere within the engagement member 130 allows the engagement member 130 to flex out of the way of an obstruction without damage.

When the seal 102 is in the initial position, the first and second portions 107, 109 of the seal 102 cover the channel 98 of the sill 42, as shown in FIGS. 4 and 9. As such, when the door panel 38 is in the open position and the seal 102 is in the initial position, the channel 98 (which may contain water, debris, and/or evaporation stains) is hidden from sight. As shown in FIGS. 5, 10, and 11, when the seal 102 is in the sealed position the second portion 109 extends downwardly at an angle from the first portion 107 toward the channel 98 such that any fluid that permeates between the second portion 109 and the first section 132 falls into the channel 98 and prevents negative drainage off of the seal 102 into the interior 26 of the structures 22.

The proximity of the door panel 38 to the threshold assembly 40 may vary longitudinally along the threshold assembly 40. Such variations in the proximity of the door panel 38 to the threshold assembly 40 may be a result of the alignment of the door panel 38 or the threshold assembly 40 within the entryway system 20. The variations in the proximity of the door panel 38 to the threshold assembly 40 may further be a result of a non-planar configuration of the lower surface 114 or the door sweep 112. The configuration of the seal 102 and the engagement member 130 compensates for variations in the proximity of the door panel 38 to the threshold assembly 40 while maintaining the seal between the seal 102 and the engagement member 130. More specifically, configuration of the seal 102 and the engagement member 130 allows for variations in the proximity of the door panel 38 to the threshold assembly 40 both horizontally and vertically.

As described above, the body 106 of the seal 102 typically extends from the stem 104 upwardly toward the door panel 38 and the first and second sections 132, 134 of the engagement member 130 typically extend downwardly toward the sill 42. As such, the seal 102 and the engagement member 130 overlap one another vertically when the door panel 38 is in the closed position shown in FIGS. 5, 10, and 11. Vertical variations in the proximity of the door panel 38 to the threshold assembly 40 are compensated for by the vertical overlap of the seal 102 and the engagement member 130 such that neither the threshold assembly 40 nor the door panel 38 needs to be adjusted in order to seal between the threshold assembly 40 and the door panel 38.

As described above, the second portion 109 extends downwardly at an angle from the first portion 107 toward the interior side 46 of the sill 42 in the initial position. The angle of the second portion 109 results in the second portion 109 extending partially horizontal. As such, the second portion 109 of the seal 102 may be contacted by the engagement member 130 over a greater portion of the sill 42 than if the second portion 109 was vertically oriented. Horizontal variations in the proximity of the door panel 38 to the threshold assembly 40 are compensated for by the horizontal extension of the seal 102, with the engagement member 130 capable of sealing against the seal 102 anywhere along the seal 102 such that neither the threshold assembly 40 nor the door panel 38 needs to be adjusted in order to seal between the threshold assembly 40 and the door panel 38.

The operation of moving the door panel 38 from the open position and the door sweep 112 from the first position, as shown in FIGS. 2-4 and 7-9, to the closed position (more specifically the completely closed position as shown in FIGS. 5, 10, and 11) and the second position, respectively, and the concurrent movement of the seal 102 from the initial position to the sealed position will be discussed below for illustrative purposes only.

Beginning with the door panel 38 in the open position and the seal 102 in the initial position, as shown in FIGS. 2-4 and 7-9, the door panel 38 is pivoted relative to the first door jamb 30 toward the closed position. The door sweep 112 correspondingly moves from the first position toward second position. The first section 132 of the engagement member 130 of the door sweep 112 engages the second portion 109 of the seal 102 adjacent the first door jamb 30 which facilitates movement of the second portion 109. The engagement of the first section 132 of the engagement member 130 of the door sweep 112 with the second portion 109 of the seal 102 adjacent the first door jamb 30 is within the range of closed positions as described above. The first section 132 of the engagement member 130 of the door sweep 112 progressively engages the second portion 109 along the seal 102 moving away from the first door jamb 30 toward the second door jamb 32 as the door panel 38 continues to pivot toward the completely closed position, as shown in FIGS. 5, 10, and 11.

The engagement of the first section 132 of the engagement member 130 of the door sweep 112 with the second portion 109 of the seal 102 moves the seal 102 from the initial position to the sealed position. The first section 132 of the engagement member 130 of the door sweep 112 may deflect as the first section 132 engages the second portion 109 of the seal 102. With the door panel 38 in the completely closed position, the entire seal 102 is disposed in the sealed position. The seal 102 is in abutment with the engagement member 130 preventing infiltration of the fluid from the exterior 24 to the interior 26 of the structure 22. The at least one fin 128 may abut the primary surface 92 of the rail 72 to further prevent infiltration of the fluid from the exterior 24 to the interior 26 of the structure 22.

The invention has been described in an illustrative manner, and it is to be understood that the terminology which has been used is intended to be in the nature of words of description rather than of limitation. As is now apparent to those skilled in the art, many modifications and variations of the subject invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. A door bottom system for use with an entryway system disposed within an aperture of a structure, which has an exterior and an interior, with the entryway system having a door panel capable of moving between an open position and a closed position, said door bottom system comprising:

a door sweep disposed below and adapted to be coupled to the door panel, with said door sweep movable between first and second positions corresponding with the open and closed positions of the door panel, respectively; and a threshold assembly disposed below said door sweep in said second position, said threshold assembly comprising:

a sill extending along an axis between an exterior side for facing the exterior of the structure and an interior side for facing the interior of the structure, with said sill defining a channel between said exterior side and said interior side which is adapted for accepting a fluid therein; and a seal coupled to said sill and extending at least partially along said axis and downwardly toward said sill to a distal end, with said seal movable along said axis between an initial position and a sealed position, and with said door sweep selectively engaging and moving said seal from said initial position when said door sweep is in said first position to said sealed position when said door sweep is in said second position for preventing infiltration of the fluid from the exterior to the interior of the structure;

wherein said seal extends over and covers said channel in said initial position when said door sweep is in said first position;

wherein said seal at least partially uncovers said channel in said sealed position such that said distal end of said seal is positioned above said channel when said door sweep is in said second position for directing any fluid that may infiltrate between said door sweep and said seal off said downwardly extending seal at said distal end and into said channel;

wherein said sill has a tread surface adjacent said exterior side of said sill and extending toward said interior side of said sill, with said tread surface sloped downwardly away from said interior side for positively draining the fluid off of said sill; and wherein said sill has at least one of a dam and a rail adjacent said tread surface, with said at least one of said dam and said rail extending upwardly away from said tread surface toward said door sweep substantially in a direction perpendicular to said axis and being disposed below said door sweep when the door sweep is in said second position; and with said seal and said tread surface on opposing sides of said at least one of said dam and said rail such that said at least one of said dam and said rail block backflow of the fluid across said tread surface to the seal and further into the interior of the structure.

2. A door bottom system as set forth in claim 1 wherein said door sweep includes a sweep frame adapted to be coupled to the door panel, and an engagement member extending from said sweep frame toward said sill with said engagement member extending along and abutting at least a portion of said seal in said second position of said door sweep.

3. A door bottom system as set forth in claim 2 wherein said engagement member extends between exterior and interior ends, with said engagement member having a first section extending from said exterior end and a second section extending from said interior end, with each of said first and second sections extending downwardly from said sweep frame toward said sill and interconnecting at a position spaced from said sweep frame.

4. A door bottom system as set forth in claim 3 wherein said first section of said engagement member is deflected in said second position of said door sweep as said first section abuts along said portion of said seal.

5. A door bottom system as set forth in claim 4 wherein said second section of said engagement member biases said first section of said engagement member toward said seal in said second position of said door sweep.

6. A door bottom system as set forth in claim 1 wherein said seal has a first portion and second portion with said first portion extending upwardly toward said door sweep to a seal juncture, and said second portion extending from said seal juncture downwardly toward said distal end of said seal.

7. A door bottom system as set forth in claim 6 wherein said sill has an engagement surface extending substantially parallel to said first portion of said seal with said first portion abutting said sill along said engagement surface for preventing intrusion of the fluid between said sill and said seal.

8. A door bottom system as set forth in claim 7 wherein said engagement surface defines a projection extending toward said first portion of said seal to deflect said first portion along said projection and further seal between said sill and said seal.

9. A door bottom system as set forth in claim 1 wherein said sill has a nosing extending upwardly toward said door sweep in said second position and at least partially defining said channel with said seal extending to and engaging said nosing at said distal end in said initial position such that said seal extends over and covers said channel when said door sweep is in said first position.

10. A door bottom system as set forth in claim 1 wherein said sill has a nosing extending upwardly toward said door sweep in said second position and at least partially defining said channel with said seal extending toward said nosing with said at least a portion of said distal end of said seal disposed above said nosing in said initial position such that said seal extends over and covers said channel when said door sweep is in said first position.

11. A door bottom system as set forth in claim 1 wherein said sill has a primary surface adjacent said seal and sloping downwardly away from said interior side of said sill for positively draining the fluid away from said seal toward said exterior side of said sill.

12. A door bottom system as set forth in claim 11 wherein said door sweep includes at least one fin extending downwardly toward said sill in a substantially linear configuration in said first position of said door sweep, with said fin abutting along said primary surface to seal against said primary surface of said sill and prevent backflow of the fluid over said sill.

13. A door bottom system as set forth in claim 1 wherein said sill includes a sill deck and said rail disposed above said sill deck with said rail having a pair of walls extending downwardly toward said sill deck, and said sill deck having said dam extending between said pair of walls of said rail to couple said rail to said sill deck.

14. A door bottom system as set forth in claim 13 wherein one of said pair of walls has a protrusion extending in a first direction and said dam has a hump extending in a second direction opposing said first direction with said protrusion and said hump selectively engaging to retain said coupling of said rail with said sill deck.

15. A door bottom system as set forth in claim 1 wherein said seal has a stem and said sill defines a slot opening toward said interior side of said sill with said stem frictionally engaging said sill within said slot to couple said seal to said sill.

16. A door bottom system as set forth in claim 1 wherein said seal is internally biased toward said initial position.

17. A door bottom system as set forth in claim 1 wherein said sill includes a sill base and a sill deck disposed above and coupled to said sill base, with said sill deck at least partially defining said channel.

18. An entryway system for disposing within an aperture of a structure which has an exterior and an interior, said entryway system comprising:

a door panel capable of moving between an open position and a closed position; and a door bottom system comprising:

a door sweep disposed below and adapted to be coupled to said door panel, with said door sweep movable between first and second positions corresponding with said open and closed positions of said door panel, respectively; and a threshold assembly disposed below said door sweep in said second position, said threshold assembly comprising:

a sill extending along an axis between an exterior side for facing the exterior of the structure and an interior side for facing the interior of the structure, with said sill defining a channel between said exterior side and said interior side which is adapted for accepting a fluid therein; and a seal coupled to said sill and extending at least partially along said axis and downwardly toward said sill to a distal end, with said seal movable along said axis between an initial position and a sealed position, and with said door sweep selectively engaging and moving said seal from said initial position when said door sweep is in said first position to said sealed position when said door sweep is in said second position for preventing infiltration of the fluid from the exterior to the interior of the structure;

wherein said seal extends over and covers said channel in said initial position when said door sweep is in said first position;

wherein said seal at least partially uncovers said channel in said sealed position such that said distal end of said seal is positioned above said channel when said door sweep is in said second position for directing any fluid that may infiltrate between said door sweep and said seal off said downwardly extending seal at said distal end and into said channel;

wherein said sill has a tread surface adjacent said exterior side of said sill and extending toward said interior side of said sill, with said tread surface sloped downwardly away from said interior side for positively draining the fluid off of said sill; and wherein said sill has at least one of a dam and a rail adjacent said tread surface, with said at least one of said dam and said rail extending upwardly away from said tread surface toward said door sweep substantially in a direction perpendicular to said axis and being disposed below said door sweep when the door sweep is in said second position; and with said seal and said tread surface on opposing sides of said at least one of said dam and said rail such that said at least one of said dam and said rail block backflow of the fluid across said tread surface to the seal and further into the interior of the structure.

19. An entryway system as set forth in claim 18 wherein said sill includes a sill deck and said rail disposed above said sill deck with said rail having a pair of walls extending downwardly toward said sill deck, and said sill deck having said dam extending between said pair of walls of said rail to couple said rail to said sill deck.

20. An entryway system as set forth in claim 18 wherein said door sweep includes a sweep frame adapted to be coupled to the door panel, and an engagement member extending from said sweep frame toward said sill with said engagement member extending along and abutting at least a portion of said seal in said second position of said door sweep.

* * * * *